US010072349B2

(12) United States Patent
Jiang et al.

(10) Patent No.: US 10,072,349 B2
(45) Date of Patent: Sep. 11, 2018

(54) ETCH SOLUTIONS HAVING BIS(PERFLUOROALKYLSULFONYL)IMIDES, AND USE THEREOF TO FORM ANODE FOILS WITH INCREASED CAPACITANCE

(71) Applicant: Pacesetter, Inc., Sunnyvale, CA (US)

(72) Inventors: Xiaofei Jiang, Clemson, SC (US); Tearl Stocker, Easley, SC (US); A. Corina Geiculescu, Easley, SC (US); Ralph Jason Hemphill, Sunset, SC (US)

(73) Assignee: PACESETTER, INC., Sunnyvale, CA (US)

( * ) Notice: Subject to any disclaimer, the term of this patent is extended or adjusted under 35 U.S.C. 154(b) by 290 days.

(21) Appl. No.: 14/988,548

(22) Filed: Jan. 5, 2016

(65) Prior Publication Data

US 2017/0191181 A1 Jul. 6, 2017

(51) Int. Cl.
*C25F 3/02* (2006.01)

(52) U.S. Cl.
CPC ..... *C25F 3/02* (2013.01)

(58) Field of Classification Search
CPC ..... C25D 3/02
See application file for complete search history.

(56) References Cited

U.S. PATENT DOCUMENTS

| | | | |
|---|---|---|---|
| 3,622,843 | A | 11/1971 | Vermilyea et al. |
| 3,662,843 | A | 5/1972 | Wise |
| 3,872,579 | A | 3/1975 | Papadopoulos et al. |
| 4,213,835 | A | 7/1980 | Fickelscher et al. |
| 4,266,332 | A | 5/1981 | Puppolo et al. |
| 4,381,231 | A | 4/1983 | Arora |
| 4,420,367 | A | 12/1983 | Locher et al. |
| 4,427,506 | A | 1/1984 | Nguyen et al. |
| 4,474,657 | A | 10/1984 | Arora et al. |
| 4,518,471 | A | 5/1985 | Arora et al. |
| 4,525,249 | A | 6/1985 | Arora et al. |
| 4,541,037 | A | 9/1985 | Ross et al. |
| 4,582,574 | A | 4/1986 | Nguyen et al. |
| 4,588,486 | A | 5/1986 | Nguyen et al. |
| 4,593,343 | A | 6/1986 | Ross et al. |
| 4,663,824 | A | 5/1987 | Kenmochi et al. |

(Continued)

FOREIGN PATENT DOCUMENTS

| | | |
|---|---|---|
| JP | 06077094 | 10/1994 |
| JP | 2001314712 | 11/2001 |

(Continued)

OTHER PUBLICATIONS

Dukhin, et al., "Acoustic and Electroacoustic Spectroscopy for Characterizing Concentrated Dispersions and Emulsions", Advances in Colloid and Interface Science 92 (2001) 73-132.
Dukhin, et al., "Ultrasound for Characterizing Colloids, Particle Sizing, Zeta Potential, Rheology", Dispersion Tehcnology, Inc., NY, USA, First Edition, 2002, 18 pages.
Notice of Allowance dated Jun. 19, 2009; Related U.S. Appl. No. 10/903,958.

(Continued)

*Primary Examiner* — Louis J Rufo
(74) *Attorney, Agent, or Firm* — Theresa A. Raymer

(57) ABSTRACT

Anode foil, preferably aluminum anode foil, is etched using a process of treating the foil in an electrolyte bath composition comprising a sulfate, a halide, an oxidizing agent, and a surface active agent. The anode foil is etched in the electrolyte bath composition by passing a charge through the bath. The etched anode foil is suitable for use in an electrolytic capacitor.

13 Claims, 6 Drawing Sheets

(56) References Cited

U.S. PATENT DOCUMENTS

| | | | | |
|---|---|---|---|---|
| 4,696,082 | A | 9/1987 | Zattara et al. | |
| 4,997,534 | A | 3/1991 | Thornton | |
| 5,131,388 | A | 7/1992 | Pless et al. | |
| 5,405,493 | A | 4/1995 | Goad | |
| 5,522,851 | A | 6/1996 | Fayram et al. | |
| 5,715,133 | A | 2/1998 | Harrington et al. | |
| 5,901,032 | A | 5/1999 | Harrington et al. | |
| 6,168,706 | B1 * | 1/2001 | Hemphill | C25F 3/04 205/213 |
| 6,224,738 | B1 | 5/2001 | Sudduth et al. | |
| 6,238,810 | B1 | 5/2001 | Strange et al. | |
| 6,736,956 | B1 | 5/2004 | Hemphill et al. | |
| 6,858,126 | B1 * | 2/2005 | Hemphill | H01G 9/055 205/324 |
| 6,955,991 | B2 | 10/2005 | Bollinger et al. | |
| 7,578,924 | B1 * | 8/2009 | Jiang | C25F 3/04 205/640 |
| 7,846,217 | B2 | 12/2010 | Poplett et al. | |
| 8,025,829 | B2 | 9/2011 | Zhang et al. | |
| 8,038,866 | B2 | 10/2011 | Hemphill et al. | |
| 8,871,358 | B2 | 10/2014 | Hemphill et al. | |
| 8,992,787 | B2 | 3/2015 | Jiang et al. | |
| 9,412,525 | B2 | 8/2016 | Bowen et al. | |
| 2002/0092777 | A1 | 5/2002 | Yoshimura et al. | |
| 2002/0108861 | A1 | 8/2002 | Emesh et al. | |
| 2003/0178320 | A1 | 9/2003 | Liu et al. | |
| 2004/0266650 | A1 | 12/2004 | Lambotte et al. | |
| 2008/0216890 | A1 | 9/2008 | Lim et al. | |
| 2008/0233307 | A1 | 9/2008 | Satou et al. | |
| 2008/0253085 | A1 | 10/2008 | Soffer et al. | |

FOREIGN PATENT DOCUMENTS

| | | | |
|---|---|---|---|
| WO | 02/092211 | 11/2002 | |
| WO | WO-02092211 A2 * | 11/2002 | B01F 17/0057 |

OTHER PUBLICATIONS

Amendment filed May 12, 2009; Related U.S. Appl. No. 10/903,958.
Final Office Action dated Nov. 12, 2008; Related U.S. Appl. No. 10/903,958.
Amendment filed Aug. 1, 2008; Related U.S. Appl. No. 10/903,958.
Non-Final Office Action dated May 1, 2008; Related U.S. Appl. No. 10/903,958.
Amendment filed Jul. 5, 2007; Related U.S. Appl. No. 10/903,958.
Notice of Allowance dated Jul. 22, 2011; Related U.S. Appl. No. 12/504,436.
Amendment filed Jun. 27, 2011; Related U.S. Appl. No. 12/504,436.
Non-Final Office Action dated Apr. 1, 2011; Related U.S. Appl. No. 12/504,436.
Non-Final Office Action dated May 31, 2012; Related U.S. Appl. No. 13/028,121.
Amendment filed Oct. 1, 2012; Related U.S. Appl. No. 13/028,121.
Final Office Action dated Dec. 10, 2012; Related U.S. Appl. No. 13/028,121.
Notice of Allowance dated Aug. 1, 2014; Related U.S. Appl. No. 13/225,182.
Amendment filed May 12, 2014; Related U.S. Appl. No. 13/225,182.
Non-Final Office Action dated Dec. 12, 2013; Related U.S. Appl. No. 13/225,182.
Amendment filed Jul. 3, 2013; Related U.S. Appl. No. 13/225,182.
Final Office Action dated Apr. 3, 2013; Related U.S. Appl. No. 13/225,182.
Amendment filed Jan. 9, 2013; Related U.S. Appl. No. 13/225,182.
Non-Final Office Action dated Oct. 9, 2012; Related U.S. Appl. No. 13/225,182.
Altenpohl, et al., "Hydrated Oxide Films on Aluminum," Jul. 1961, Journal of Electrochemical society, p. 628-631.
Derwent, "Derwent—1994-129852", 2013.
JPO, "JPO machine translation of JP06-77094, Nov. 1, 2013, JPO".

* cited by examiner

ETCH SOLUTIONS HAVING BIS(PERFLUOROALKYLSULFONYL)IMIDES, AND USE THEREOF TO FORM ANODE FOILS WITH INCREASED CAPACITANCE

BACKGROUND OF THE INVENTION

Field of the Invention

The present disclosure relates generally to methods of using a etch solutions with particular surface active agents to reduce the tendency for overetching and surface erosion during etching of high purity cubicity anode foil. The disclosure also relates to electrolyte bath compositions for such use, to etched foils produced by such methods, and to electrolytic capacitors.

Related Art

Compact, high voltage capacitors are utilized as energy storage reservoirs in many applications, including implantable medical devices. These capacitors are required to have a high energy density since it is desirable to minimize the overall size of the implanted device. This is particularly true of an implantable cardioverter defibrillator (ICD), also referred to as an implantable defibrillator, since the high voltage capacitors used to deliver the defibrillation pulse can occupy as much as one third of the ICD volume.

Implantable cardioverter defibrillators, such as those disclosed in U.S. Pat. No. 5,131,388, incorporated herein by reference, typically use two electrolytic capacitors in series to achieve the desired high voltage for shock delivery. For example, an implantable cardioverter defibrillator may utilize two 350 to 400 volt electrolytic capacitors in series to achieve a voltage of 700 to 800 volts.

Electrolytic capacitors are used in ICDs because they have the most nearly ideal properties in terms of size and ability to withstand relatively high voltage. Conventionally, an electrolytic capacitor includes an etched aluminum foil anode, an aluminum foil or film cathode, and an interposed kraft paper or fabric gauze separator impregnated with a solvent-based liquid electrolyte. The electrolyte impregnated in the separator functions as the cathode in continuity with the cathode foil, while an oxide layer on the anode foil functions as the dielectric.

In ICDs, as in other applications where space is a critical design element, it is desirable to use capacitors with the greatest possible capacitance per unit volume. Since the capacitance of an electrolytic capacitor increases with the surface area of its electrodes, increasing the surface area of the aluminum anode foil results in increased capacitance per unit volume of the electrolytic capacitor. By electrolytically etching aluminum foils, enlargement of the foil surface area occurs. As a result of this enlarged surface area, electrolytic capacitors, manufactured with these etched foils, can obtain a given capacity with a smaller volume than an electrolytic capacitor which utilizes a foil with an unetched surface.

In a conventional electrolytic etching process, foil surface area is increased by removing portions of the aluminum foil to create etch tunnels. While electrolytic capacitors having anodes and cathodes comprised of aluminum foil are most common, anode and cathode foils of other conventional valve metals such as titanium, tantalum, magnesium, niobium, zirconium and zinc are also used. Electrolytic etching processes are illustrated in U.S. Pat. Nos. 4,213,835, 4,420,367, 4,474,657, 4,518,471, 4,525,249, 4,427,506, and 5,901,032.

In conventional processes for etching aluminum foil, an electrolytic bath is used that contains a sulfate, a halide, and an oxidizing agent, such as sodium perchlorate, such as the processes disclosed in U.S. Pat. Nos. 8,871,358, 8,038,866, 7,578,924, 6,858,126, and 6,238,810. Aluminum electrolytic capacitors' energy density is directly related to the surface area of the anodes generated in the electrochemical etching processes. Typical surface area increases are 40 to 1 and represent 30 to 40 million tunnels/cm$^2$. An electrochemical widening step is used to increase the tunnel diameter after etching to insure the formation oxide will not close off the tunnels. Closing off of the tunnels during formation will reduce capacitance and electrical porosity.

It would be advantageous to utilize an etch process, particularly for a direct current (DC) etch process, using agents that prevent closing off of the tunnels during formation and increase foil capacitance and anode strength.

SUMMARY OF THE INVENTION

The present disclosure provides improved methods and compositions for the etching of anode foils, as well as etched anode foils provided by such methods and compositions. An embodiment of the disclosure provides a method for etching an anode foil by treating the foil in an aqueous electrolyte bath composition comprising a sulfate, a halide, an oxidizing agent, and a bis(perfluoroalkylsulfonyl)imide surface active agent, and passing a charge through the anode foil while the foil is immersed in the electrolyte bath. The method includes treating the foil in an aqueous electrolyte bath composition that includes a surface active agent, such as, e.g., lithium bis(perfluoroethylsulfonyl)imide, and the method results in increased foil capacitance.

In another embodiment of the disclosure, the anode foil is precleaned prior to treating the foil in an aqueous electrolyte bath composition. Precleaning is conducted by immersing the foil in a corrosive composition, such as hydrochloric acid.

Another embodiment of the disclosure is directed to an aqueous electrolyte bath composition for etching anode foil. The composition includes a sulfate, a halide, an oxidizing agent, and a bis(perfluoroalkylsulfonyl)imide surface active agent. The composition can include a chloride, such as sodium chloride, lithium bis(perfluoroethylsulfonyl)imide, and an oxidizing agent such as a perchlorate, e.g., sodium perchlorate.

It has been discovered that a bis(perfluoroalkylsulfonyl) imide surface active agent, which is thermally and electrochemically stable, can be used in etch processes to obtain a high capacitance yield in a stable etch solution that is easy to maintain. Accordingly, the present disclosure provides improved methods and compositions for etching anode foil, as well as anode foils produced using such methods.

DETAILED DESCRIPTION OF THE INVENTION

Figure 1:
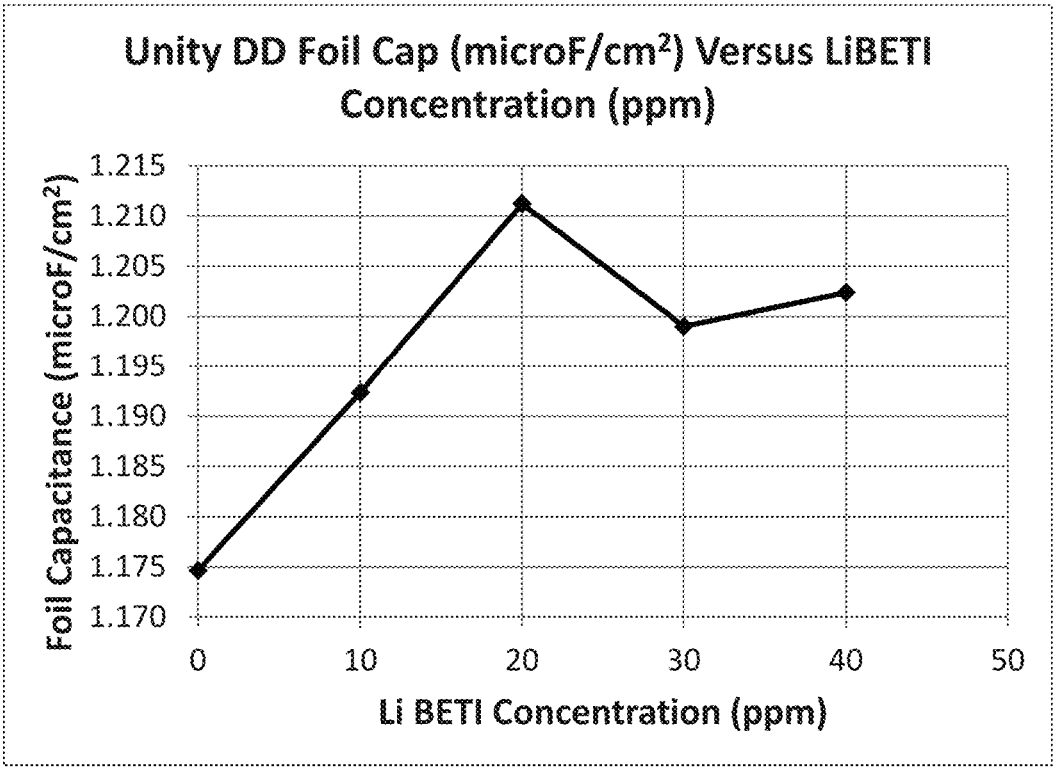
FIG. 1 illustrates the foil capacitance versus the concentration of lithium bis(perfluoroethylsulfonyl)imide in the etch electrolyte composition, after etching of an aluminum anode foil according to the present disclosure.

The present disclosure provides compositions and methods for etching of anode foils, especially aluminum anode foils, to increase surface area and capacitance. Several factors contribute to increasing the specific capacitance of aluminum electrolytic capacitor foil. One factor is the amount of increase in tunnel density (i.e., the number of tunnels per square centimeter). As tunnel density is increased, a corresponding enlargement of the overall surface area will occur. Another factor controlling the increase in specific capacitance is the length of the etch tunnel. Longer tunnels or through tunnels result in higher surface area. The tunnel density and tunnel length are both determined by the type of etch process.

Using the electrolyte bath composition of the present disclosure, the foil can be etched anodically under the influence of a charge in an electrolyte bath. In particular, the foil can be etched by treating the anode foil in an electrolyte bath composition comprising a sulfate, a halide, an oxidizing agent, and a bis(perfluoroalkylsulfonyl)imide surface active agent, and passing a charge through the anode foil while the foil is immersed in the electrolyte bath. Any and all embodiments of the electrolyte bath composition may be employed in the methods for etching of anode foils of the present disclosure.

The electrolytic bath composition of the present disclosure contains a sulfate ($SO_4^{2-}$). The sulfate is provided by a sulfate salt or acid. Suitable sulfate salts and acids include sodium sulfate, potassium sulfate, lithium sulfate, and sulfuric acid, or other soluble sulfate salts, with sulfuric acid preferred. The amount of sulfate salt or acid provided in the electrolytic bath composition can range from about 100 parts per million (ppm) to about 2000 ppm (e.g. ranging from about 250 ppm to about 1000 ppm). In another embodiment, the sulfate salt or acid is provided in an amount of from about 0.8 to about 1.0 weight percent being preferred.

The electrolyte bath composition also contains a halide. The halide is provided by a halide salt, acid, or mixture thereof. The type of halide salt or acid is not particularly limited, so long as the halide ion is provided to interact with the sulfate. The halide is believed to help provide for pit initiation and tunnel propagation of the anode foil. Suitable halide salts and acids include titanium (III) chloride, sodium chloride, and hydrochloric acid. A preferred halide salt or acid is hydrochloric acid. The amount of the halide salt or acid added ranges from about 1% to about 6% by weight of the electrolyte bath composition, more preferably ranging from about 0.5% to about 3% by weight.

The electrolyte bath composition also contains an oxidizing agent that is used in conjunction with the halide, provided in the bath by addition of, for example iodic acid, iodine pentoxide, iodine trichloride, sodium perchlorate, sodium peroxide, hydrogen peroxide, sodium pyrosulfate, and mixtures thereof. Preferably, the oxidizing agent is thermally stable and/or chemically stable, e.g. it is not unduly reduced at the cathode, and helps to create high tunnel density and long tunnels for the etched foil. A preferred oxidizing agent is perchlorate, provided by sodium perchlorate. In one embodiment, sodium perchlorate is used in conjunction with a halide, provided by, e.g., hydrochloric acid.

The amount of oxidizing agent ranges from about 2% to about 12% by weight of the electrolyte bath composition, more preferably ranging from about 2% to about 6% by weight. Preferably, the weight ratio of oxidizing agent to halide is at least about 2 to 1, as measured by the weight of the perchlorate salt and the halide salt or acid used to create the bath. In one embodiment, the weight ratio of oxidizing agent to halide is about 2 to 1. In another embodiment, the weight ratio of oxidizing agent to halide is about 5.6 to 1.

As an example, the amount of sodium perchlorate added can range from about 2% to about 12% by weight of the electrolyte bath composition, more preferably ranging from about 2% to about 6% by weight. Similarly, the amount of sodium chloride added can range from about 1% to about 6% by weight of the electrolyte bath composition; more preferably ranging from about 1% to about 3% by weight. Illustratively, the weight ratio of sodium perchlorate added to sodium chloride added is about 2 to 1.

The electrolyte bath composition also contains a bis(perfluoroalkylsulfonyl)imide surface active agent. It has been discovered that particular surface active agents increase foil capacitance and lower the amount of etching coulombs to achieve an equivalent surface area. In addition, less surface erosion on the foil improves the anode strength leading to higher anode punch yields. Suitable surface active agents include bis(perfluoroalkylsulfonyl)imides, typically provided as acids or as salts thereof, such as those described in International Publication Number WO 02/092211, which is entirely incorporated by reference herein. Preferably, the salt of the bis(perfluoroalkylsulfonyl)imide is an alkali metal salt or an ammonium salt. More preferably, the salt of the bis(perfluoroalkylsulfonyl)imide is a sodium, potassium, lithium, or ammonium salt. Even more preferably, the salt of the bis(perfluoroalkylsulfonyl)imide is a lithium salt. Preferably, the alkyl group of the bis(perfluoroalkylsulfonyl)imide is a C1-C4 alkyl group. More preferably, the bis(perfluoroalkylsulfonyl)imide is a bis(perfluoroethylsulfonyl)imide or a bis(perfluorobutylsulfonyl)imide. Even more preferably, the bis(perfluoroalkylsulfonyl)imide is a bis(perfluoroethylsulfonyl)imide. In one embodiment, the imide is provided as the acid. In another embodiment, the imide is provided as a salt thereof.

It is desirable to employ an amount of surface active agent that increases foil capacitance, lowers the amount of etching coulombs to achieve an equivalent surface area, and reduces surface erosion on the foil, improving anode strength leading to higher anode punch yields. Suitable amounts of surface active agent include from about 10 ppm to about 40 ppm. For instance, the surface active agent is present in the amount of about 15 ppm, about 16 ppm, about 17 ppm, about 18 ppm, about 19 ppm, about 20 ppm, about 21 ppm, about 22 ppm, about 23 ppm, about 24 ppm, or about 25 ppm.

For example, foil capacitance is expected to increase with increasing amounts of surface active agent up to about 20 ppm. Above the 20 ppm level, foil capacitance is expected to remain constant or decrease.

An illustrative electrolytic bath composition for use in the present method comprises bis(perfluoroethylsulfonyl)imide provided by about 20 ppm lithium bis(perfluoroethylsulfonyl)imide, chloride provided by 0.62 weight percent hydrochloric acid, sulfate provided by 0.92 weight percent sulfuric acid, and perchlorate provided by 3.5 weight percent sodium perchlorate.

In the method of the present disclosure, the foil can be etched anodically under the influence of an electrical charge in an electrolyte bath, preferably by a direct current (DC). The use of a DC charge will be discussed below.

Using the method of the present disclosure, foil capacitance is increased compared to unetched foil. In an embodiment of the present disclosure, the foil capacitance is increased by about 3%. In another embodiment of the present disclosure, the foil capacitance is increased by about 7% to about 8%. In another embodiment, the foil capacitance is increased by about 3% or by about 7% to about 8% wherein the bis(perfluoroalkylsulfonyl)imide is a bis(perfluoroethylsulfonyl)imide. In another embodiment, the foil capacitance is increased by about 3% or by about 7% to about 8% wherein the bis(perfluoroalkylsulfonyl)imide is a bis(perfluorobutylsulfonyl)imide. In a preferred embodiment, the foil capacitance is increased by about 3% wherein the bis(perfluoroalkylsulfonyl)imide is provided by a lithium salt.

The electrolyte bath composition is heated to a temperature ranging from about 60° C. and 95° C. (e.g. about 75° C. and about 85° C.), with about 80° C. to 81° C. preferred. Illustratively, foil capacitance is expected to increase with increasing temperature, with a peak capacitance in the range of about 80° C. to about 81° C.

The foil (preferably a high purity, high cubicity etchable strip as supplied by vendors known to those in the art, and also as discussed below) is inserted into the electrolyte bath composition of the present disclosure and etched at a DC charge density in an amount ranging from about 0.1 to about 0.5 A/cm$^2$ (e.g., ranging from about 0.1 to about 0.4 A/cm$^2$, or from about 0.1 to 0.3 A/cm$^2$), with about 0.15 A/cm$^2$ preferred. The etching can be carried out with an etching charge ranging from about 20 to about 100 coulombs/cm$^2$ (e.g. ranging from about 40 to about 80 coulombs/cm$^2$, or about 60 to about 80 coulombs/cm$^2$, or about 60 to about 70 coulombs/cm$^2$), with a range of about 60 to about 70 coulombs/cm$^2$ preferred. The time for which the foil is etched ranges from about 2 minutes to about 11 minutes (e.g., about 2 minutes, 13 seconds to about 11 minutes, 6 seconds), with about 6½ to about 7½ minutes preferred (e.g., about 6 minutes, 40 seconds to about 7 minutes, 47 seconds). As is understood by those skilled in the art, the etch charge and time will depend upon the specific applications for which the foil is to be used.

In an embodiment of the disclosure, the etch electrolyte bath composition is maintained at a solids level in an amount ranging from about 5 g/L to about 40 g/L. For example, when aluminum foil is etched according to the methods of the present disclosure, a portion of the solid aluminum hydroxide generated during etching may be removed from the electrolyte bath composition by passing the composition through a medium with a pore size sufficient to filter the solids to an acceptable level. For example, the porous medium may have a pore size ranging from about 25 microns and about 40 microns.

In another embodiment of the disclosure, the foil is precleaned prior to etching. By "precleaning" it is meant that the foil, preferably aluminum foil, is activated by partly removing the natural oxide or contamination and reveals portions of the fresh aluminum surface on which sulfate ions can promote tunnel initiation. Proper precleaning prior to etching results in an increased capacity for the resulting etched foil.

Precleaning of the foil is accomplished by immersing the foil in a corrosive solution, such as HCl, $H_2SO_4$, $H_3PO_4$, or other commercially available solutions such as the Hubbard-Hall Lusterclean solution for a time sufficient to partly expose the fresh aluminum metal on the foil. For example, the foil can be immersed in an aqueous solution containing HCl in an amount ranging from about 0.1% to about 2% by weight (e.g. from about 0.1 to about 1% by weight, or about 0.2% to about 0.5% by weight), preferably about 0.2% by weight, for a time ranging from about 20 seconds to about 2 minutes (e.g. from about 20 seconds to about 1 minute), preferably about 20 seconds. The foil is preferably immersed in the corrosive solution at room temperature (e.g., about 20 to about 30° C.). The foil may then be rinsed with water, preferably deionized water, for at least about one minute.

The foil used for etching according to the present method is preferably etchable aluminum strip of high cubicity. High cubicity in the context of the present disclosure is where at least 80% of crystalline aluminum structure is oriented in a normal position (i.e., a (1, 0, 0) orientation) relative to the surface of the foil. The foil used for etching is also preferably of high purity. Such foils are well-known in the art and are readily available from commercial sources. Illustratively, the thickness of the aluminum foil ranges from about 50 to about 200 microns, preferably from about 110 microns to about 114 microns.

After etching, the foil is removed from the etch solution and rinsed in deionized water. The tunnels formed during the initial etch are then widened, or enlarged, in a secondary etch solution, typically an aqueous based nitrate solution, preferably between about 1% to about 20% aluminum nitrate, more preferably between about 10% to about 14% aluminum nitrate, with less than about 1% free nitric acid. The etch tunnels are widened to an appropriate diameter by methods known to those in the art, such as that disclosed in U.S. Pat. No. 4,518,471 and U.S. Pat. No. 4,525,249, both of which are incorporated herein by reference. In embodiments of the disclosure, the widening charge ranges from about 60 to about 90 coulombs/cm$^2$, more preferably about 70 to about 80 coulombs/cm$^2$.

After the etch tunnels have been widened, the foil is again rinsed with deionized water and dried. Finally, a barrier oxide layer is formed onto the metal foil by placing the foil into an electrolyte bath and applying a positive voltage to the metal foil and a negative voltage to the electrolyte. The barrier oxide layer provides a high resistance to current passing between the electrolyte and the metal foils in the finished capacitor, also referred to as the leakage current. A high leakage current can result in the poor performance and reliability of an electrolytic capacitor. In particular, a high leakage current results in greater amount of charge leaking out of the capacitor once it has been charged.

The formation process consists of applying a voltage to the foil through an electrolyte such as boric acid and water or other solutions familiar to those skilled in the art, resulting in the formation of an oxide on the surface of the anode foil. The preferred electrolyte for formation is a 100-1000 μS/cm, preferably 500 μS/cm, citric acid concentration. In the case of an aluminum anode foil, the formation process results in the formation of aluminum oxide ($Al_2O_3$) on the surface of the anode foil. The thickness of the oxide deposited or "formed" on the anode foil is proportional to the applied voltage, roughly 10 to 15 Angstroms per applied volt. The formation voltage can be about 250 Volts or higher, preferably about 250 Volts to about 600 Volts, more preferably about 450 Volts to about 510 Volts. The etched and formed anode foils can then be cut and used in the assembly of a capacitor.

The present disclosure thus also provides etched anode foil etched by methods and/or compositions according to the present disclosure. For example, the etched foil can be an etched aluminum foil provided by a method comprising passing a direct charge through an anode foil while the foil is immersed in an electrolyte bath, such that the anode foil is etched, wherein the electrolyte bath comprises sulfate provided by sulfuric acid, halide provided by hydrochloric acid, and a bis(perfluoroalkylsulfonyl)imide provided by a salt of a bis(perfluoroalkylsulfonyl)imide, wherein the foil capacitance is increased relative to unetched foil. The etched anode foil may be etched by any and all embodiments of the electrolyte bath composition. Suitably, the sulfuric acid is provided at about 0.92 weight percent, the hydrochloric acid is provided at about 0.62 weight percent, the ratio of halide to perchlorate is about 2:1, the salt of the bis(perfluoroalkylsulfonyl)imide is provided at about 10 ppm to about 40 ppm, and the foil capacitance is increased by at least 3% relative to unetched foil. Preferably, the etched foil is provided by a method wherein the bis(perfluoroalkylsulfonyl)imide is a bis(perfluoroethylsulfonyl)imide or a bis(perfluorobutylsulfonyl)imide. More preferably, the etched foil is provided by a method wherein the bis(perfluoroalkylsulfonyl)imide is provided by lithium bis(perfluoroethylsulfonyl)imide.

The present disclosure thus also provides electrolytic capacitors comprising etched anode foil etched by methods and/or compositions according to the present disclosure. Such capacitors can be made using any suitable method known in the art. Non-limiting examples of such methods are disclosed, e.g., in the following references which are entirely incorporated herein by reference: U.S. Pat. No. 4,696,082 to Fonfria et al., U.S. Pat. No. 4,663,824 to Kemnochi, U.S. Pat. No. 3,872,579 to Papadopoulos, U.S. Pat. No. 4,541,037 to Ross et al., U.S. Pat. No. 4,266,332 to Markarian et al., U.S. Pat. No. 3,622,843 to Vermilyea et al., and U.S. Pat. No. 4,593,343 to Ross. The rated voltage of the electrolytic capacitor is preferably above about 250 Volts, such as, e.g. between about 250 Volts and 1000 Volts. Preferably, the voltage is about 400 Volts or higher, more preferably about 400 to about 550 Volts. Illustrative capacitance is about 1.0 $\mu F/cm^2$ to about 1.4 $\mu F/cm^2$.

The process of the present disclosure results in a very efficient and economical etching process that yields capacitance values equal to or significantly higher than available foils, without requiring major changes in existing production machinery. The present disclosure provides improved anode strength, leading to higher anode punch yields. Further, the sulfate ion in the chloride containing solution of the present disclosure preferentially adsorbs on the aluminum oxide layer on an aluminum surface of the foil and prevents the chloride ion from attacking the foil and causing the pitting potential to increase. Once the pitting starts, and fresh foil surface is exposed to the etch solution, the sulfate ion can boost the tunnel growth speed and generate long tunnels and branch tunnels.

While the above description and following examples are directed to an embodiment of the present disclosure where a sulfate is added to an etch electrolyte solution to increase the capacitance of aluminum anode foil, sulfate ion can be applied to etch electrolytes to increase the capacitance of other anode foils known to those skilled in the art. For example, the process according to the present disclosure can be used to increase the capacitance of valve metal anode foils such as aluminum, tantalum, titanium, and columbium (niobium).

Electrolytic capacitors manufactured with anode foils etched according to the present disclosure may be utilized in ICDs, such as those described in U.S. Pat. No. 5,522,851 to Fayram. An increase in capacitance per unit volume of the electrolytic capacitor will allow for a reduction in the size of the ICD.

Having now generally described the disclosure, the same will be more readily understood through reference to the following examples which are provided by way of illustration, and are not intended to be limiting of the present disclosure.

EXAMPLES

Example 1

The effect of surface active agent concentration in an etch electrolyte solution on resulting foil capacitance was investigated.

Lithium bis(perfluoroethylsulfonyl)imide was mixed into a low pH etch electrochemical solution containing chloride and strong oxidizers, prepared by providing about 10 ppm to about 40 ppm lithium bis(perfluoroethylsulfonyl)imide in an aqueous solution of chloride provided by hydrochloric acid present at 0.62 weight percent, sulfate provided by sulfuric acid present at 0.92 weight percent, and perchlorate provided by sodium perchlorate present at 3.5 weight percent.

FIG. 1 shows the foil capacitance as a function of the concentration of lithium bis(perfluoroethylsulfonyl)imide added, at 475 Volts EFV.

Example 2

The effect of using a surface active agent in an etch electrolyte composition on resulting foil surface erosion and tunnel distribution was investigated.

Figure 2A:
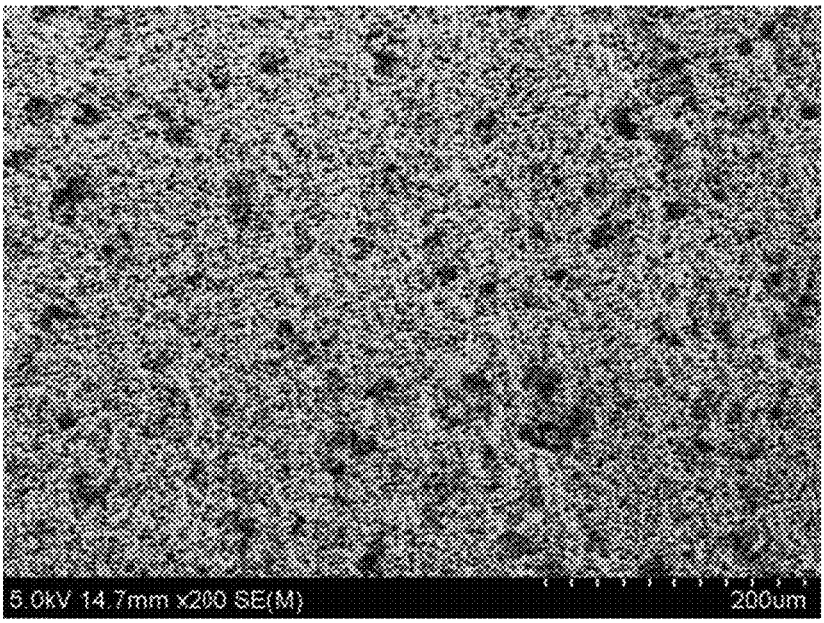
FIG. 2A illustrates an SEM image of etched foil surface etched in a control bath.
Figure 2B:
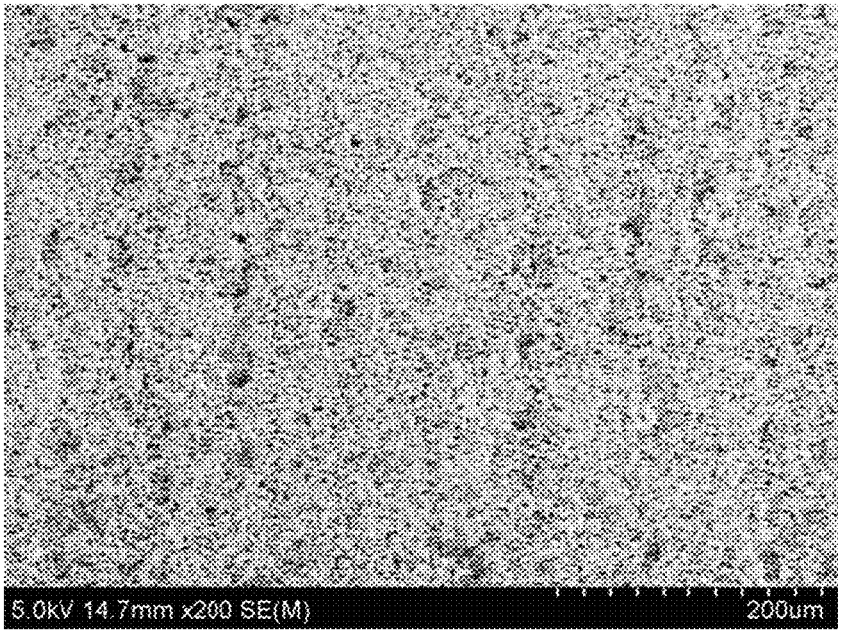
FIG. 2B illustrates an SEM image of etched foil surface etched in an electrolyte bath provided according to the present disclosure, prepared using lithium bis(perfluoroethylsulfonyl)imide.

The etched foil resulting from Example 1 was studied by SEM, and the resulting SEM image was compared to that of an etched foil etched in a control bath prepared without lithium bis(perfluoroethylsulfonyl)imide. SEM images of the two foils are shown in FIGS. 2A and 2B. The surface erosion and tunnel distribution are very much improved in the foil prepared in the lithium bis(perfluoroethylsulfonyl) imide electrolyte bath composition.

Example 3

Figure 3:
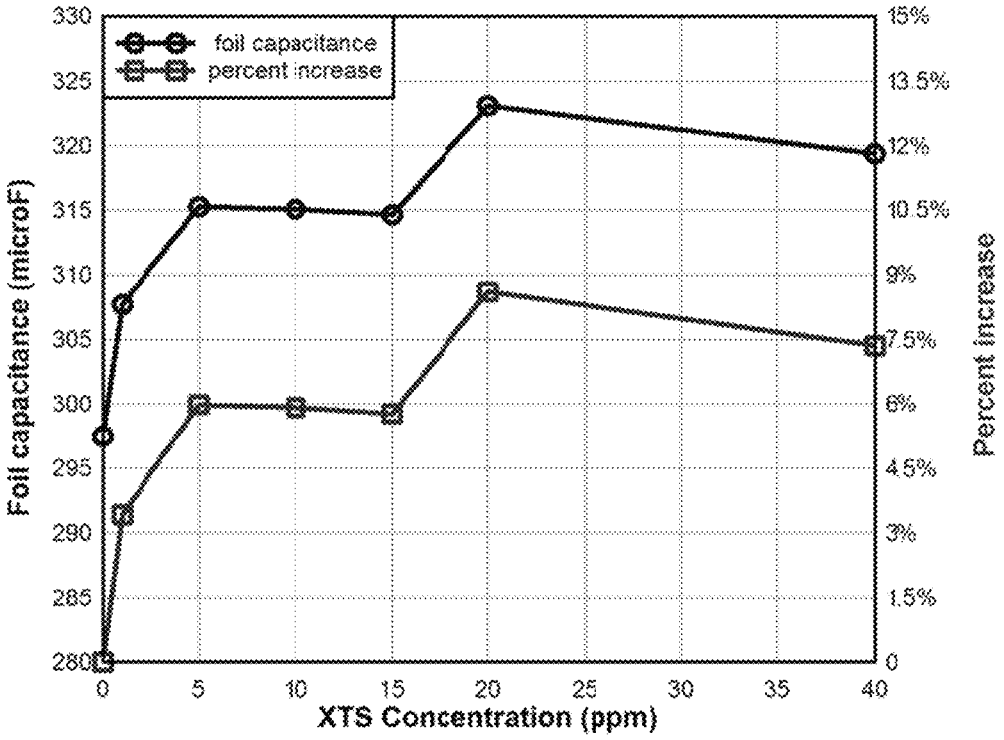
FIG. 3 illustrates the foil capacitance versus the concentration of potassium bis(perfluorobutylsulfonyl)imide added to the etch electrolyte composition, after etching of an aluminum anode foil according to the present disclosure.

Potassium bis(perfluorobutylsulfonyl)imide was mixed at different concentrations into an acid etch electrochemical solution. The aluminum foils were widened using an electrochemical widening process and then formed to 475 Volts before final foil capacitance tests. FIG. 3 shows foil capacitance as a function of the concentration of potassium bis (perfluorobutylsulfonyl)imide added and percent increase in capacitance.

Example 4

Figure 4A:
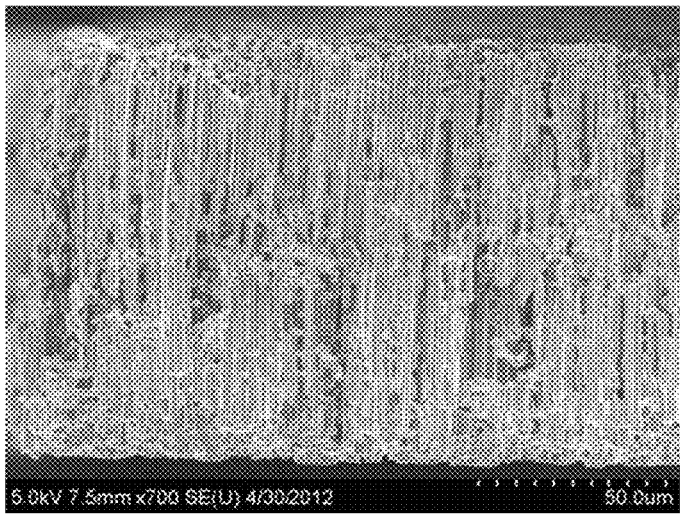
FIG. 4A illustrates an SEM image of etched foil surface etched in a control acid bath.
Figure 4B:
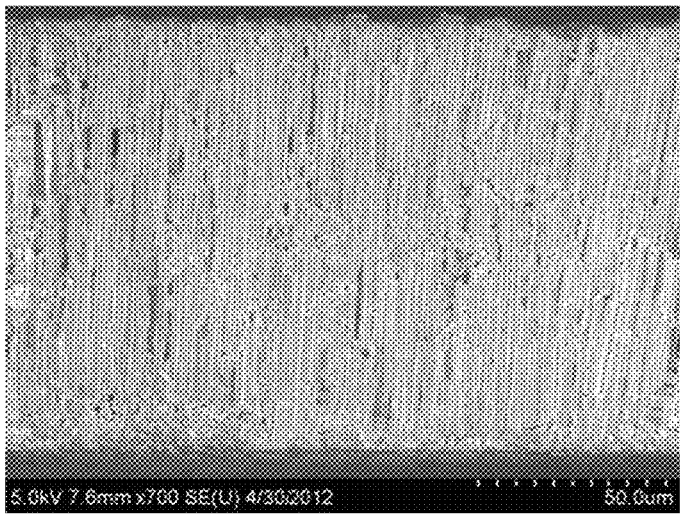
FIG. 4B illustrates an SEM image of etched foil surface etched in an acid electrolyte bath provided according to the present disclosure, prepared using potassium bis(perfluorobutylsulfonyl)imide.

The etched foil resulting from Example 3 using 5 ppm potassium bis(perfluorobutylsulfonyl)imide in an acid bath was studied by SEM, and the resulting SEM image was compared to that of an etched foil etched in a control acid bath prepared without the bis(perfluorobutylsulfonyl)imide salt. SEM images of the two foils are shown in FIGS. 4A and 4B. The surfactant-etched foil exhibits less surface erosion, less tunnel merging, higher tunnel density, and longer tunnel length.

Example 5

A single capacitor was built using the foil etched with 20 ppm potassium bis(perfluorobutylsulfonyl)imide, and the test data are shown in Table 1 below. The average foil capacitance is 334 uF, and the single capacitor delivered energy is about 21 J, which is improved compared to capacitors built without the method of the present disclosure.

TABLE 1

| Run | Exit Leak @ age | Total Chg. Time | Del. Energy | Chg. Eff. | Droop | Stored Energy | Leak. | DE After SS | DSR | ESR | Thick. After MCT |
|---|---|---|---|---|---|---|---|---|---|---|---|
| 1 | 415 | 13.6 | 20.74 | 64.9 | 9.3 | 23.14 | 436 | 22.49 | 0.896 | 2.51 | 0.264 |
| 2 | 420 | 13.6 | 20.80 | 64.7 | 10.3 | 23.18 | 423 | 22.47 | 0.897 | 2.52 | 0.264 |
| 3 | 440 | 13.6 | 21.07 | 65.9 | 10.3 | 23.28 | 423 | 22.77 | 0.905 | 2.43 | 0.264 |
| 4 | 430 | 13.6 | 21.22 | 66.3 | 9.8 | 23.46 | 415 | 22.88 | 0.905 | 2.49 | 0.265 |
| 5 | 420 | 13.5 | 20.86 | 65.7 | 10.3 | 23.14 | 390 | 21.99 | 0.901 | 2.89 | 0.264 |
| 6 | 420 | 13.5 | 21.00 | 66.2 | 9.8 | 23.15 | 406 | 23.30 | 0.907 | 2.29 | 0.262 |
| 7 | 400 | 13.6 | 21.10 | 66.0 | 10.3 | 23.23 | 393 | 22.81 | 0.908 | 2.44 | 0.263 |
| 8 | 420 | 13.4 | 21.03 | 67.1 | 9.8 | 23.14 | 423 | 22.65 | 0.909 | 2.41 | 0.263 |
| 9 | 440 | 13.3 | 20.91 | 66.9 | 10.3 | 23.00 | 398 | 22.46 | 0.909 | 2.39 | 0.262 |
| 10 | 410 | 13.5 | 20.94 | 66.3 | 10.3 | 23.18 | 417 | 22.44 | 0.903 | 2.42 | 0.263 |
| Average | 422 | 13.5 | 20.97 | 66.0 | 10.1 | 23.19 | 412 | 22.63 | 0.904 | 2.48 | 0.263 |
| StDev | 12 | 0.1 | 0.15 | 0.8 | 0.4 | 0.12 | 15 | 0.35 | 0.005 | 0.16 | 0.001 |

While various embodiments of the present disclosure have been described above, it should be understood that they have been presented by way of example only, and not limitation. Thus, the breadth and scope of the present disclosure should not be limited by any of the above-described exemplary embodiments, but should be defined only in accordance with the following claims and their equivalents. Additionally, all references cited herein, including journal articles or abstracts, published or corresponding U.S. or foreign patent applications, issued U.S. or foreign patents, or any other references, are each entirely incorporated by reference herein, including all data, tables, figures, and text presented in the cited references.

It must be noted that as used in the present disclosure and in the appended claims, the singular forms "a", "an", and "the" include plural reference unless the context clearly dictates otherwise. Illustratively, the term "a sulfate salt or acid" is intended to include one or more sulfate salts or acids, including mixtures thereof (e.g., sodium sulfate, potassium sulfate, and/or mixtures thereof) and the term "a halide salt or acid" is intended to include one or more halide salts or acids, including mixtures thereof (e.g. sodium chloride, potassium chloride, and lithium chloride, and/or mixtures thereof).

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure and the appended claims in any way.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. An electrolyte bath composition for etching anode foil, comprising:
- a sulfate;
- a halide;
- an oxidizing agent;
- and a bis(perfluoroalkylsulfonyl)imide;
- in an aqueous solvent,
- wherein the bis(perfluoroalkylsulfonyl)imide is a bis(perfluoroethylsulfonyl)imide present in an amount ranging from about 10 to about 20 ppm.

2. The composition of claim 1, wherein the sulfate is provided by a salt or acid selected from the group consisting of sodium sulfate, potassium sulfate, lithium sulfate, sulfuric acid, and mixtures thereof.

3. The composition of claim 1, wherein the halide is provided by a salt or acid selected from the group consisting of sodium chloride, titanium (III) chloride, hydrochloric acid, and any mixture thereof.

4. The composition of claim 1, wherein the sulfate is provided by sulfuric acid.

5. The composition of claim 4, wherein the sulfuric acid is present at about 0.92 weight percent.

6. The composition of claim 1, wherein the ratio of halide to oxidizing agent is about 2:1.

7. The composition of claim 1, wherein the bis(perfluoroalkylsulfonyl)imide is provided as an alkali metal salt or an ammonium salt.

8. The composition of claim 7, wherein the salt of the bis(perfluoroalkylsolfonyl)imide is a sodium, potassium, lithium, or ammonium salt.

9. The composition of claim 1 wherein the halide is provided by hydrochloric acid.

10. The composition of claim 9, wherein the hydrochloric acid is added at about 0.62 weight percent.

11. The composition of claim 1, wherein the oxidizing agent is provided by sodium perchlorate added at about 3.5 weight percent.

12. The composition of claim 1, wherein the bis(perfluoroalkylsulfonyl)imide is provided as an alkali metal salt or an ammonium salt.

13. The composition of claim 11, wherein the salt of the bis(perfluoroalkylsulfonyl)imide is a sodium, potassium, lithium, or ammonium salt.

* * * * *